US007305779B1

(12) United States Patent
Purvis

(10) Patent No.: US 7,305,779 B1
(45) Date of Patent: Dec. 11, 2007

(54) SNOW-SHOVELING APPARATUS

(76) Inventor: Richard A. Purvis, 3100 Danbury Cir., Spotsylvania, VA (US) 22553

( * ) Notice: Subject to any disclaimer, the term of this patent is extended or adjusted under 35 U.S.C. 154(b) by 329 days.

(21) Appl. No.: 11/090,131

(22) Filed: Mar. 28, 2005

(51) Int. Cl.
*E01H 5/02* (2006.01)

(52) U.S. Cl. ..... 37/285; 37/284; 37/265; 294/54.5

(58) Field of Classification Search ..... 37/283, 37/284, 285, 265; 294/51, 53.5, 54.5, 57
See application file for complete search history.

(56) References Cited

U.S. PATENT DOCUMENTS

| | | | | | |
|---|---|---|---|---|---|
| 841,848 | A | | 1/1907 | Conner | |
| 1,534,179 | A | * | 4/1925 | Klinger | 37/284 |
| 1,693,472 | A | | 11/1928 | Batty | |
| 2,114,641 | A | | 4/1938 | Stevenson | |
| 2,653,397 | A | * | 9/1953 | Butler | 37/241 |
| 2,863,232 | A | * | 12/1958 | Steinbach et al. | 37/284 |
| 2,896,993 | A | * | 7/1959 | Pollock | 37/283 |
| 2,919,153 | A | * | 12/1959 | Benton | 294/51 |
| 2,967,363 | A | * | 1/1961 | Meier | 37/283 |
| 4,559,726 | A | * | 12/1985 | Moisan | 37/267 |
| 4,910,893 | A | * | 3/1990 | Asay | 37/281 |
| 5,159,769 | A | | 11/1992 | Odorisio | |
| 5,440,828 | A | * | 8/1995 | Simpson | 37/285 |
| 5,630,633 | A | * | 5/1997 | Dupre et al. | 294/53.5 |
| D381,875 | S | | 8/1997 | Spear et al. | |
| 5,669,163 | A | * | 9/1997 | Winter | 37/284 |
| D392,522 | S | | 3/1998 | Kenyon | |
| 5,829,808 | A | * | 11/1998 | Colla | 294/53.5 |
| 5,975,602 | A | * | 11/1999 | Zan | 294/54.5 |
| 6,053,548 | A | * | 4/2000 | Bowles, Jr. | 294/54.5 |
| 6,237,975 | B1 | | 5/2001 | Drobot | |
| 6,290,273 | B1 | | 9/2001 | Moisan | |
| 6,435,580 | B1 | * | 8/2002 | Lock | 294/54.5 |
| 6,457,757 | B2 | * | 10/2002 | Hendrick | 294/54.5 |
| 6,675,507 | B2 | * | 1/2004 | Petruzzelli | 37/284 |
| 2005/0160632 | A1 | * | 7/2005 | Williams | 37/265 |
| 2006/0249964 | A1 | * | 11/2006 | Brazeau | 294/54.5 |

* cited by examiner

*Primary Examiner*—Thomas A Beach

(57) ABSTRACT

An apparatus includes a shaft that has proximal and distal end portions. The shaft includes spaced grip covers conjoined about an outer surface thereof and is provided with a centrally registered sleeve formed therein. An arcuately shaped plow section is affixed to the distal end portion and includes a heel support that has an arcuately shaped top surface for assisting to maintain the plow section registered along a horizontal plane. The plow section further includes fastening members spaced along the bottom edge for removing the bottom edge to be sharpened or replaced. The apparatus further includes a mechanism for pivoting the plow section between alternate radial paths during operating conditions. A mechanism is included for automatically biasing the plow section to an equilibrium position after the plow section is biased to a pivoted position.

6 Claims, 6 Drawing Sheets

SNOW-SHOVELING APPARATUS

CROSS REFERENCE TO RELATED APPLICATIONS

Not Applicable.

STATEMENT REGARDING FEDERALLY SPONSORED RESEARCH OR DEVELOPMENT

Not Applicable.

REFERENCE TO A MICROFICHE APPENDIX

Not Applicable.

BACKGROUND OF THE INVENTION

1. Technical Field

This invention relates to snow shovels and, more particularly, to a snow-shoveling apparatus for more effectively shoveling snow and the like.

2. Prior Art

The use of snow shovels is known in the prior art. More specifically, snow shovels heretofore devised and utilized are known to consist basically of familiar, expected, and obvious structural configurations, notwithstanding the myriad of designs encompassed by the crowded prior art which have been developed for the fulfillment of countless objectives and requirements.

Conventional snow shovels are used to move articles such as snow and the like. In general, such snow shovels have an elongated handle and a slightly curved shovel portion attached to one end of the handle. Unfortunately, shovels of this type of design are not very effective and convenient to use. They require that a person be fairly physically fit and flexible in order to use them for shoveling large quantities of snow, as is often the case during the winter season. For this reason, many elderly and physically disabled persons are unable to do this chore themselves, and must hire snow removers, which can become quite costly.

Accordingly, a need remains for a snow-shoveling apparatus in order to overcome the above-noted shortcomings. The present invention satisfies such a need by providing a snow-shoveling apparatus that is convenient and easy to use, durable in design, results in reduced fatigue and strain, and is efficient in its intended purpose. Such an apparatus has an angled shaft allowing a user to assume an upright position during use, thus minimizing the amount that a person needs to bend. The angled shaft also assists in enhancing lifting power as well. Foam rubber grips on the shaft allow a user to securely and comfortable grip the apparatus while still being able to effectively utilize the same. Homeowners and contracted snow removers can quickly push snow out of the pathway of people and cars on sidewalks and driveways with minimal effort when using the apparatus. Such an apparatus, requiring reduced effort and strain, is especially useful to the elderly and people with physical disabilities.

BRIEF SUMMARY OF THE INVENTION

In view of the foregoing background, it is therefore an object of the present invention to provide a snow-shoveling apparatus. These and other objects, features, and advantages of the invention are provided by a hand-operable apparatus for shoveling snow and the like.

The apparatus includes an elongated shaft that has axially offset proximal and distal end portions. Such a shaft includes a plurality of spaced bifurcated and adjustable grip covers conjoined about an outer surface thereof and situated adjacent to the proximate end portion. The shaft is further provided with a centrally registered sleeve formed therein.

An arcuate shaped plow section is affixed to the distal end portion of the shaft. Such a plow section includes a heel support that has an arcuately shaped top surface symmetrically contoured with a lower portion of the plow section for assisting to maintain the plow section registered along a horizontal plane during operating conditions. The plow section preferably has a linear top edge transversely registered with the shaft and traveling downwardly along an arcuate path. The plow section may further have a removable linear bottom edge (described herein below) situated subjacent to the top edge and spanning across a width of the plow section in such a manner that the bottom and top edge define a congruous surface area monolithically formed therebetween. The plow section further includes a plurality of fastening members spaced along the bottom edge for removing the bottom edge such that the bottom edge can be sharpened or replaced. The plow section also has a non-uniform interior radius.

Such a plow section preferably has a pair of laterally positioned open end portions monolithically formed with the top and bottom edges. One of the open end portions has a diameter greater than a diameter of another open end portions so that snow can advantageously be laterally directed across the surface area while the apparatus is propelled along a forward direction orthogonal to a width of the plow section.

The apparatus further includes a mechanism for selectively pivoting the plow section between alternate radial paths during operating conditions. Such a pivoting mechanism preferably includes a flexible and elongated cable that has opposed end portions disposed adjacent to the proximal and distal end portions of the shaft. The cable is nested within the groove and travels along a longitudinal length of the shaft. A manually operable controller may be coupled to one of the cable end portions.

Preferably, a first deformably resilient spring member is intercalated within the sleeve and operably fastened to the cable adjacent to the controller and a second deformably resilient spring member is nested within the distal end portion of the shaft. A plurality of interlocked pins are operably coupled to the cable and the distal end portion of the shaft. A release lever is pivotally connected to the shaft and is movable between raised and lowered positions. The first and second spring members cooperate with the pins for positioning the cable between tensed and equilibrium states when the operator disengages the controller so that the plow section can conveniently be locked at alternately displaced angles offset from the shaft.

A mechanism is included for automatically biasing the plow section to an equilibrium position after the plow section is biased to a pivoted position. Such an automatic biasing mechanism cooperates with the pivoting mechanism in such a manner that an operator can advantageously effectively remove snow from a ground surface while propelling the apparatus in a forward and substantially horizontal direction.

The automatic biasing mechanism preferably includes a plurality of oppositely disposed helical spring members equidistantly offset from the shaft and a plurality of brackets securely affixed to the distal end portion of the shaft and a rear surface of the plow section respectively. Such helical spring members have opposed end portions fastened to the brackets, resisting a rotational force exerted thereon when the plow section is biased along alternate radial paths.

It is noted the purpose of the foregoing abstract is to enable the U.S. Patent and Trademark Office and the public generally, especially the scientists, engineers and practitioners in the art who are not familiar with patent or legal terms or phraseology, to determine quickly from a cursory inspection the nature and essence of the technical disclosure of the application. The abstract is neither intended to define the invention of the application, which is measured by the claims, nor is it intended to be limiting as to the scope of the invention in any way.

BRIEF DESCRIPTION OF THE SEVERAL VIEWS OF THE DRAWING

The novel features believed to be characteristic of this invention are set forth with particularity in the appended claims. The invention itself, however, both as to its organization and method of operation, together with further objects and advantages thereof, may best be understood by reference to the following description taken in connection with the accompanying drawings in which:

DETAILED DESCRIPTION OF THE INVENTION

Figure 1:
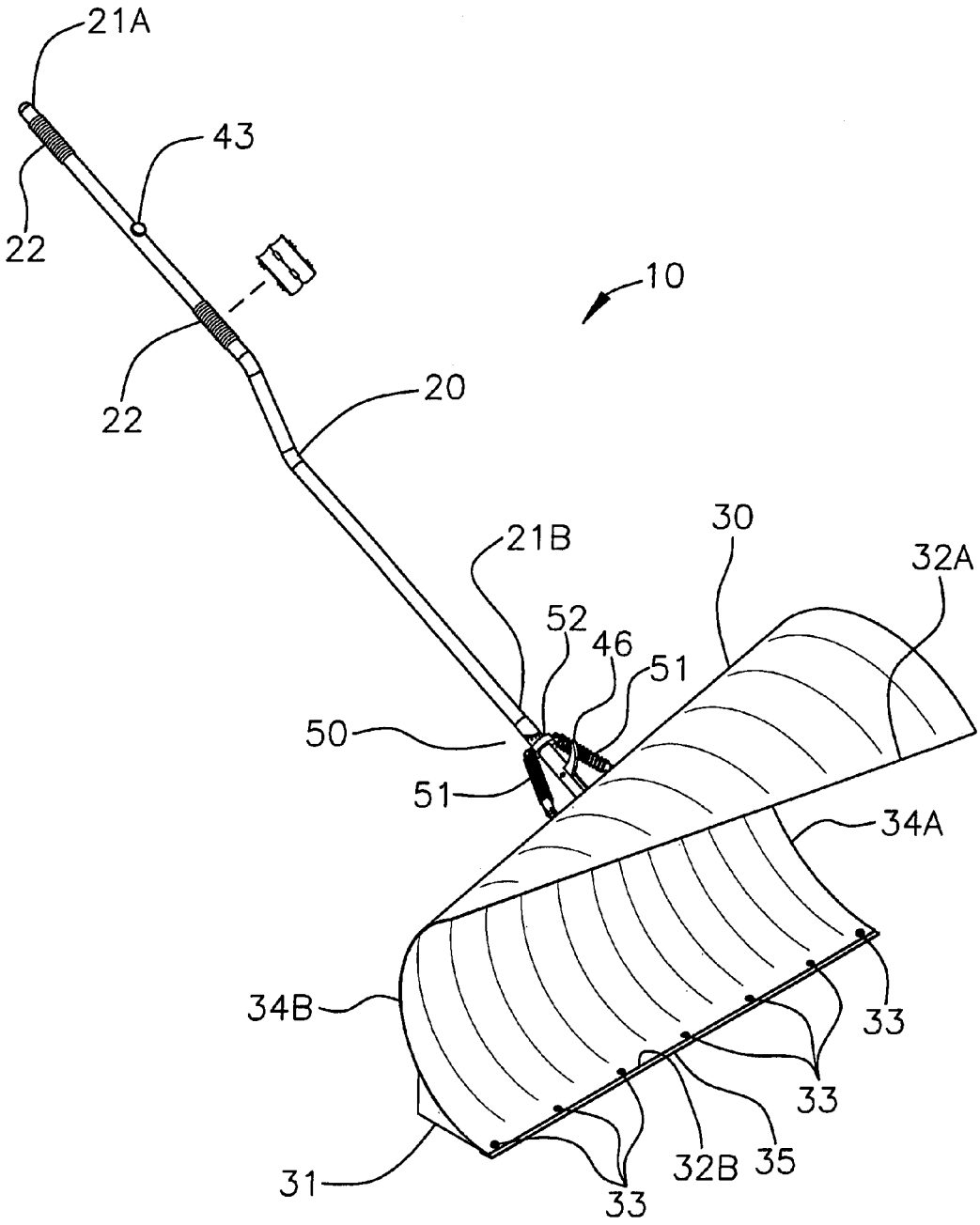
FIG. 1 is a perspective view showing a snow-shoveling apparatus, in accordance with the present invention.
Figure 2:
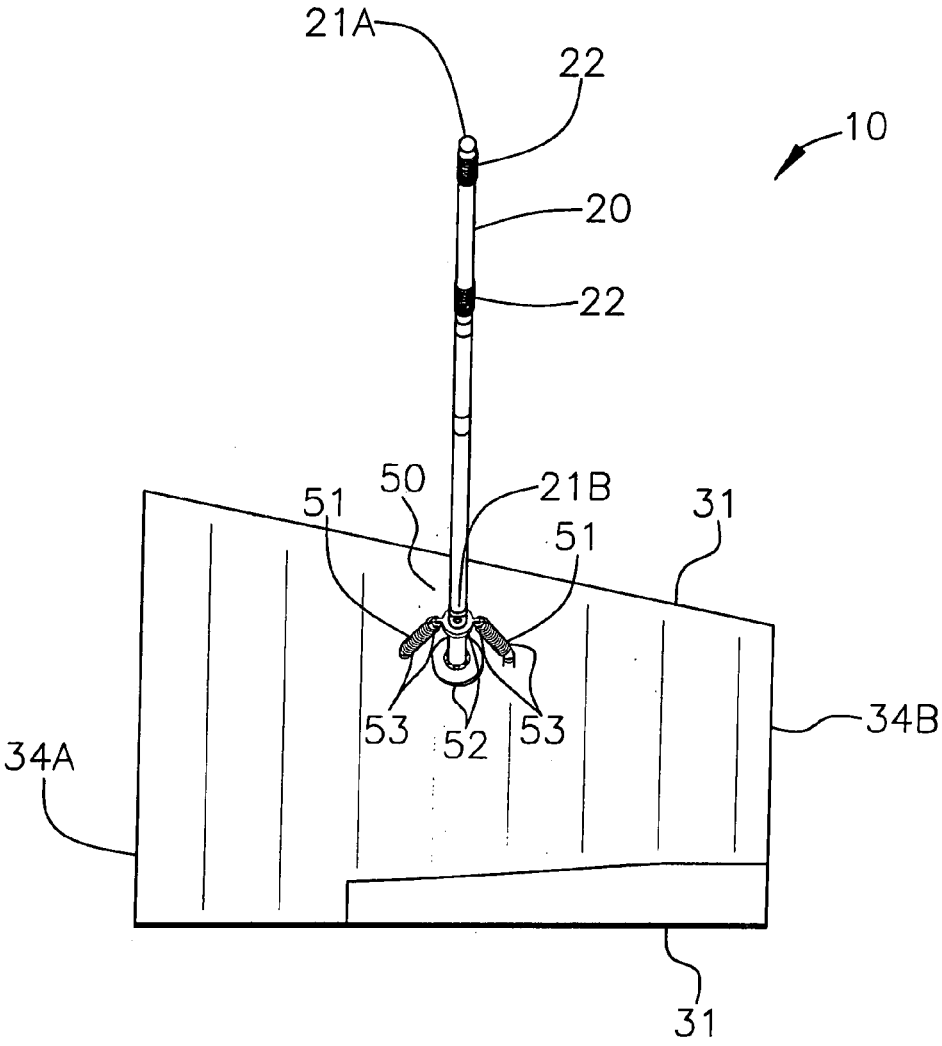
FIG. 2 is a rear end view of the apparatus shown in FIG. 1.
Figure 3:
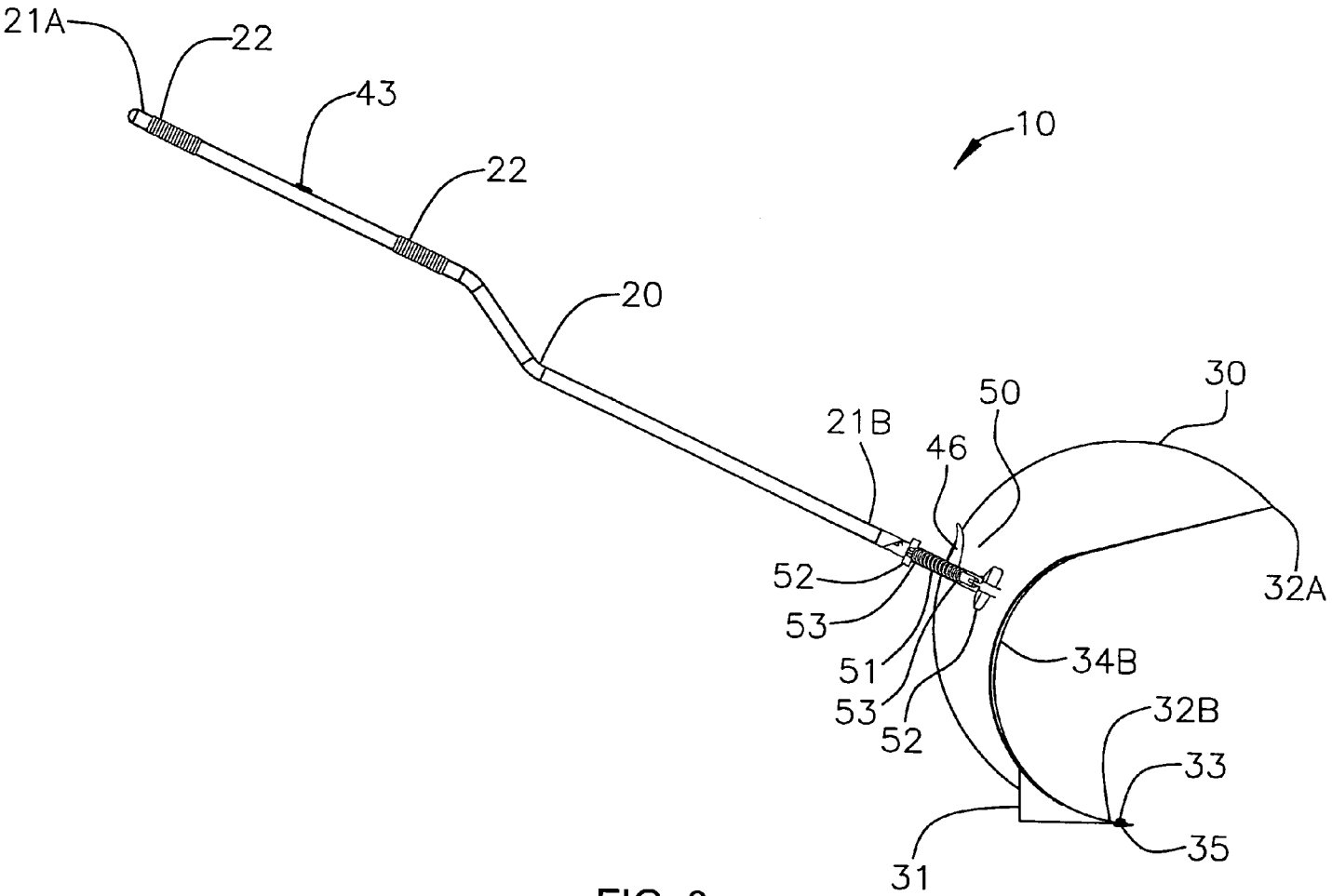
FIG. 3 is a side-elevational view of the apparatus shown in FIG. 1.

The present invention will now be described more fully hereinafter with reference to the accompanying drawings, in which a preferred embodiment of the invention is shown. This invention may, however, be embodied in many different forms and should not be construed as limited to the embodiment set forth herein. Rather, this embodiment is provided so that this application will be thorough and complete, and will fully convey the true scope of the invention to those skilled in the art. Like numbers refer to like elements throughout the figures.

The apparatus of this invention is referred to generally in FIGS. 1-6 by the reference numeral 10 and is intended to provide a snow-shoveling apparatus. It should be understood that the apparatus 10 may be used to shovel many different types of debris and should not be limited in use to only shoveling snow.

Figure 6:
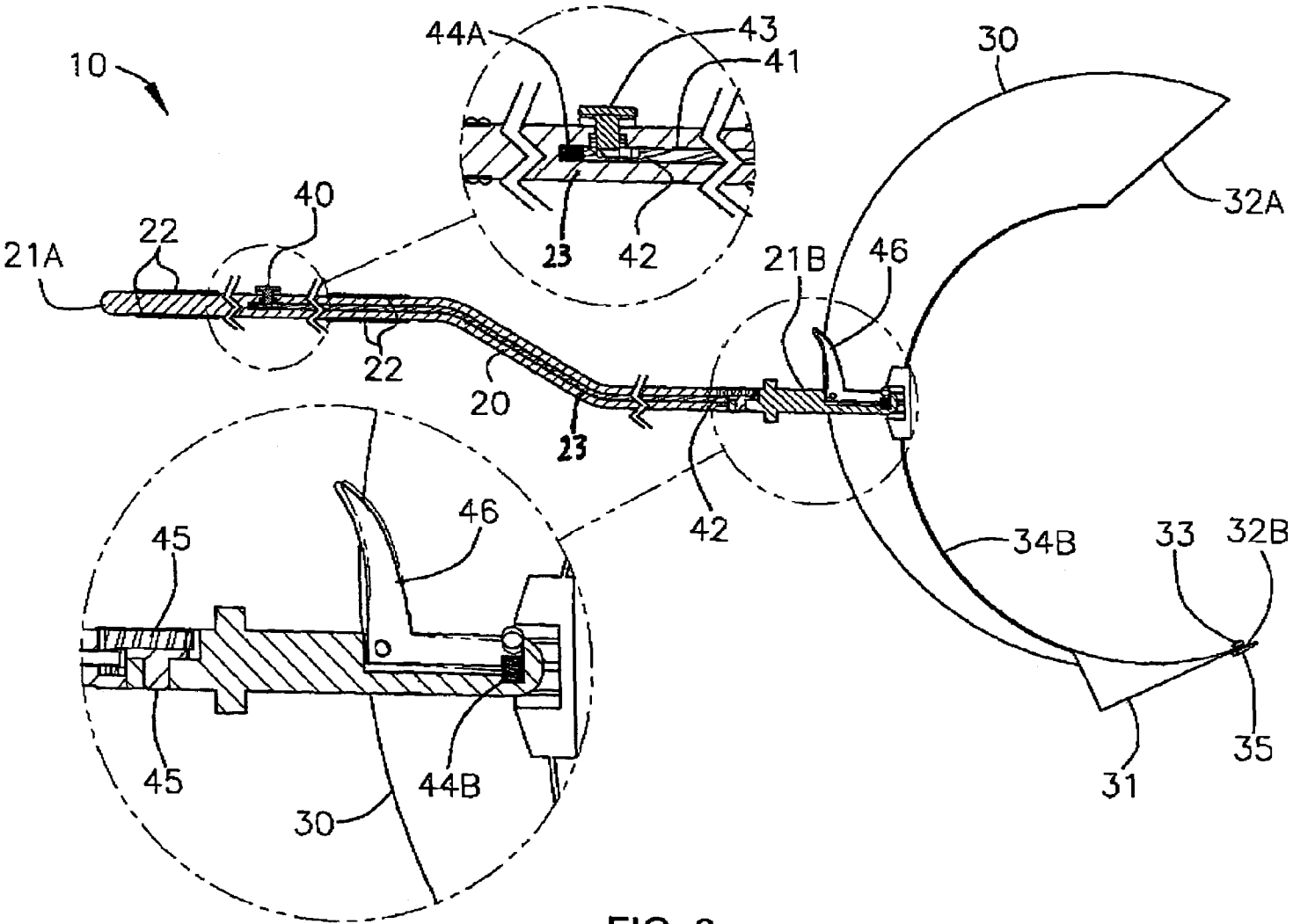
FIG. 6 is a cross-sectional view of the apparatus shown in FIG. 1, showing enlarged views of the pivoting and automatic biasing mechanisms.

Referring initially to FIGS. 1 and 6, the apparatus 10 includes an elongated shaft 20 that has axially offset proximal 21A and distal 21B end portions. Such a shaft 20 includes a plurality of spaced bifurcated and adjustable grip covers 22 conjoined about an outer surface thereof and situated adjacent to the proximate end portion 21A. The shaft 20 is further provided with a centrally registered sleeve 23 that is formed therein.

Referring to FIGS. 1 through 6, an arcuately shaped plow section 30 is affixed to the distal end portion 21B of the shaft 20. Such a plow section 30 includes a heel support 31 that has an arcuately shaped top surface symmetrically contoured with a removable linear bottom edge 32B (described herein below) of the plow section 30 for assisting to maintain the plow section 30 registered along a horizontal plane during operating conditions, thus advantageously ensuring the optimal amount of snow is displaced by the apparatus 10. The plow section 30 has a linear top edge 32A transversely registered with the shaft 20 and traveling downwardly along an arcuate path.

Still referring to FIGS. 1 through 6, the plow section 30 further has a linear bottom edge 32B situated subjacent to the top edge 32A and spanning across a width of the plow section 30 in such a manner that the bottom 32B and top 32A edge define a congruous surface area monolithically formed therebetween. The plow section 30 further includes a plurality of fastening members 33 spaced along the bottom edge 32B for removing the bottom edge 32B such that the bottom edge 32B can be sharpened or replaced. The plow section 30 also has a non-uniform interior radius. An elongated rigid clip 35 is affixed to the bottom edge 32B for assisting the user to effectively displace snow 11 and the like from the ground surface 12

Such a plow section 30 has a pair of laterally positioned open end portions 34 monolithically formed with the top 32A and bottom 32B edges. One 34A of the open end portions 34 has a diameter greater than a diameter of another 34B open end portions 34 so that snow 11 can advantageously be laterally directed across the surface area while the apparatus 10 is propelled along a forward direction orthogonal to a width of the plow section 30. Such a plow section 30 design advantageously allows snow to be pushed and displaced with a minimal amount of effort and physical strain.

Figure 4:
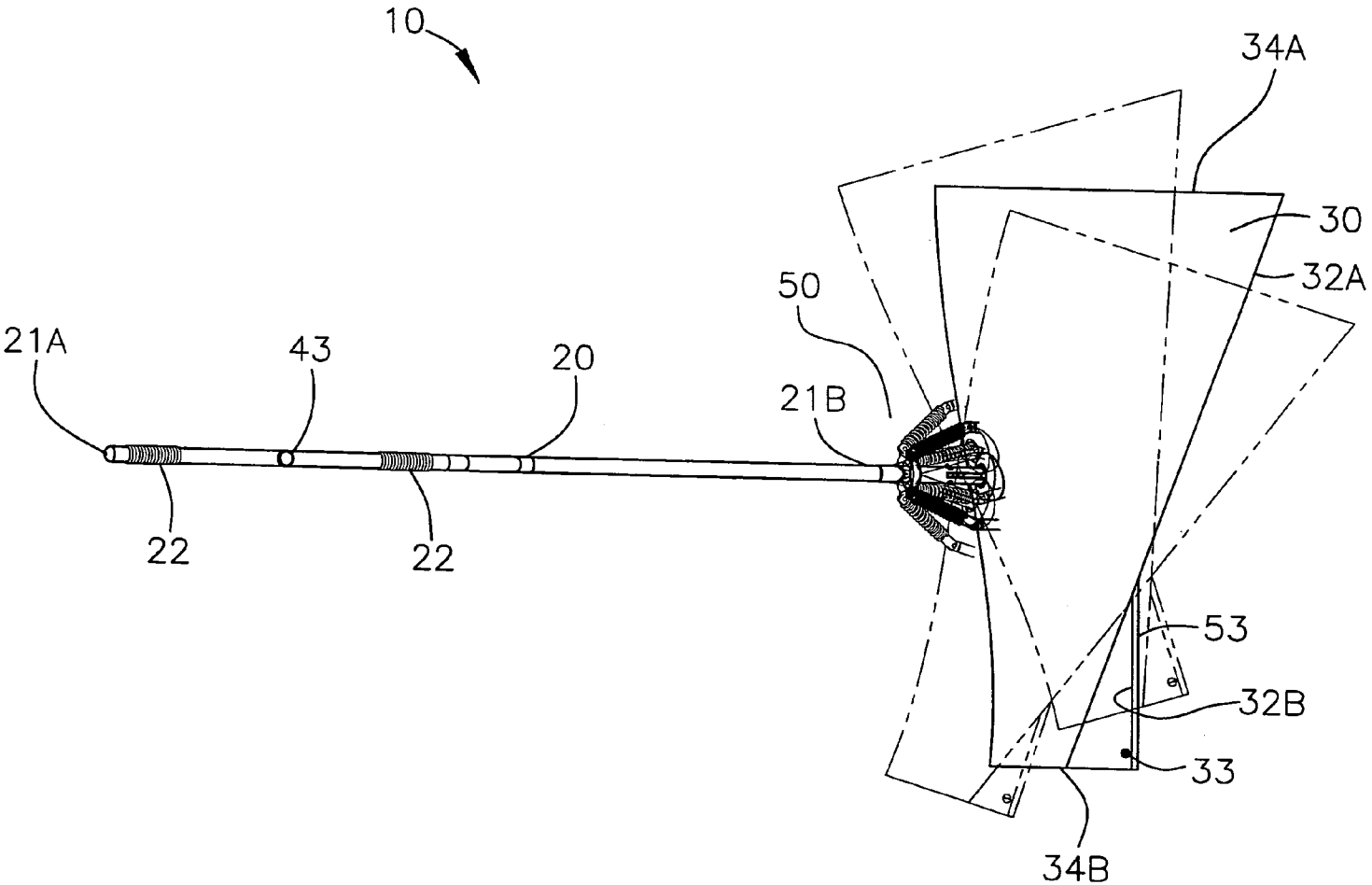
FIG. 4 is a top plan view of the apparatus shown in FIG. 1, showing a pivotal movement of the plow section.
Figure 5:
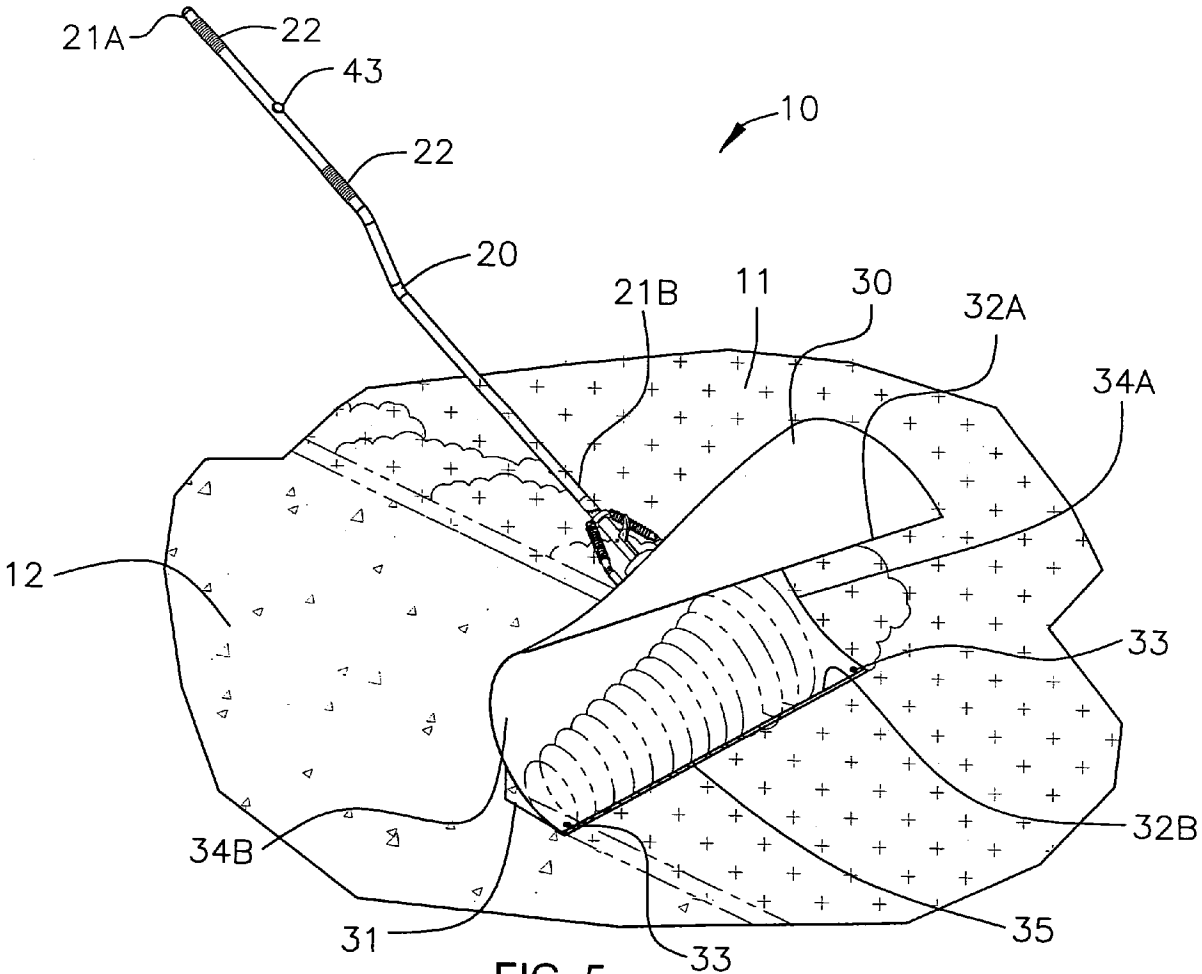
FIG. 5 is a perspective view of the apparatus shown in FIG. 1, showing the apparatus during operating conditions.

Referring to FIGS. 1, 4 and 6, the apparatus 10 further includes a mechanism 40 for selectively pivoting the plow section 30 between alternate radial paths during operating conditions. Such a pivoting mechanism 40 includes a flexible and elongated cable 41 that has opposed end portions 42 disposed adjacent to the proximal 21A and distal 21B end portions of the shaft 20. The cable 41 is nested within the sleeve 23 and travels along a longitudinal length of the shaft 20. A manually operable controller 43 is coupled to one of the cable end portions 42.

Referring to FIGS. 4 and 6, a first 44A deformably resilient spring member 44 is intercalated within the sleeve 23 and operably fastened to the cable 41 adjacent to the controller 43 and a second 44B deformably resilient spring member 44 is nested within the distal end portion 21B of the shaft 20. A plurality of interlocked pins 45 are operably coupled to the cable 41 and the distal end portion 21B of the shaft 20. A release lever 46 is pivotally connected to the shaft 20 and is movable between raised and lowered positions.

The first 44A and second 44B spring members cooperate with the pins 45 for positioning the cable 41 between tensed and equilibrium states when the operator disengages the controller 43 so that the plow section 30 can conveniently be locked at alternately displaced angles offset from the shaft 20. This feature advantageously allows the plow section 30 to be adjusted in such a manner that the displaced snow 11 may be directed for deposit in various locations, as is best shown in FIG. 4.

Referring to FIGS. 1 through 6, a mechanism 50 is included for automatically biasing the plow section 30 to an equilibrium position after the plow section 30 is biased to a pivoted position. Such an automatic biasing mechanism 50 cooperates with the pivoting mechanism 40 in such a manner that an operator can advantageously effectively remove snow 11 from a ground surface 12 while propelling the apparatus 10 in a forward and substantially horizontal direction.

Still referring to FIGS. 1 through 6, the automatic biasing mechanism 50 includes a plurality of oppositely disposed helical spring members 51 equidistantly offset from the shaft 20 and a plurality of brackets 52 securely affixed to the distal end portion 21B of the shaft 20 and a rear surface of the plow section 30 respectively. Such helical spring members 51 have opposed end portions 53 fastened to the brackets 52, resisting a rotational force exerted thereon when the plow section 30 is biased along alternate radial paths.

While the invention has been described with respect to a certain specific embodiment, it will be appreciated that many modifications and changes may be made by those skilled in the art without departing from the spirit of the invention. It is intended, therefore, by the appended claims to cover all such modifications and changes as fall within the true spirit and scope of the invention.

In particular, with respect to the above description, it is to be realized that the optimum dimensional relationships for the parts of the present invention may include variations in size, materials, shape, form, function and manner of operation. The assembly and use of the present invention are deemed readily apparent and obvious to one skilled in the art.

What is claimed as new and what is desired to secure by Letters Patent of the United States is:

1. A hand-operable apparatus for shoveling snow and the like, said apparatus comprising:

an elongated shaft having axially offset proximal and distal end portions, said shaft including a plurality of bifurcated and adjustable grip covers removably conjoined about an outer surface thereof and situated adjacent said proximate end portion, said shaft being provided with a centrally registered sleeve formed therein;

an arcuately shaped plow section affixed to said distal end portion of said shaft;

means for selectively pivoting said plow section between alternate radial paths during operating conditions; and means for automatically biasing said plow section to an equilibrium position after said plow section is biased to a pivoted position, said automatic biasing means cooperating with said pivoting means in such a manner that an operator can effectively remove snow from a ground surface while propelling said apparatus in a forward and substantially horizontal direction;

wherein said plow section has a linear top edge transversely registered with said shaft and traveling downwardly along an arcuate path;

wherein said plow section further has a removable linear bottom edge situated subjacent said top edge and spanning across a width of said plow section in such a manner that said bottom and top edge define a congruous surface area monolithically formed therebetween;

wherein said plow section has a pair of laterally positioned open end portions monolithically formed with said top and bottom edges, one said open end portions having a diameter greater than a diameter of another said open end portions so that snow can be laterally directed across said surface area while said apparatus is propelled along a forward direction orthogonal to a width of said plow section;

wherein said pivoting means comprises:

a flexible and elongated cable having opposed end portions disposed adjacent said proximal and distal end portions of said shaft, said cable being nested within the groove and traveling along a longitudinal length of said shaft;

a manually operable controller coupled to one said cable end portions;

a first deformably resilient spring member intercalated within said centrally registered sleeve and operably fastened to said cable adjacent said controller;

a second deformably resilient spring member nested within said distal end portion of said shaft;

a plurality of interlocked pins operably coupled to said cable and said distal end portion of said shaft; and a release lever pivotally connected to said shaft and being movable between raised and lowered positions;

wherein said first and second spring members cooperate with said pins for positioning said cable between tensed and equilibrium states when the operator disengages said controller so that said plow section can be locked at alternately displaced angles offset from said shaft.

2. The apparatus of claim 1, wherein said automatic biasing means comprises:

a plurality of oppositely disposed helical spring members equidistantly offset from said shaft; and a plurality of brackets securely affixed to said distal end portion of said shaft and a rear surface of said plow section respectively;

wherein said helical spring members have opposed end portions fastened to said brackets, said helical spring members resisting a rotational force exerted thereon when said plow section is biased along alternate radial paths.

3. A hand-operable apparatus for shoveling snow and the like, said apparatus comprising:

an elongated shaft having axially offset proximal and distal end portions, said shaft including a plurality of bifurcated and adjustable grip covers removably conjoined about an outer surface thereof and situated adjacent said proximate end portion, said shaft being provided with a centrally registered sleeve formed therein;

an arcuately shaped plow section affixed to said distal end portion of said shaft, said plow section including a heel support having an arcuately shaped top surface symmetrically contoured with a removable linear bottom edge of said plow section for assisting to maintain said plow section registered along a horizontal plane during operating conditions, said plow section further including a plurality of fastening members spaced along said bottom edge for removing said bottom edge such that said bottom edge can be sharpened or replaced;

means for selectively pivoting said plow section between alternate radial paths during operating conditions; and means for automatically biasing said plow section to an equilibrium position after said plow section is biased to a pivoted position, said automatic biasing means cooperating with said pivoting means in such a manner that an operator can effectively remove snow from a ground surface while propelling said apparatus in a forward and substantially horizontal direction;

wherein said plow section has a linear top edge transversely registered with said shaft and traveling downwardly along an arcuate path;

wherein said removable linear bottom edge is situated subjacent said top edge and spans across a width of said plow section in such a manner that said bottom and top edge define a congruous surface area monolithically formed therebetween;

wherein said plow section has a pair of laterally positioned open end portions monolithically formed with said top and bottom edges, one said open end portions having a diameter greater than a diameter of another said open end portions so that snow can be laterally directed across said surface area while said apparatus is propelled along a forward direction orthogonal to a width of said plow section;

wherein said pivoting means comprises:

a flexible and elongated cable having opposed end portions disposed adjacent said proximal and distal end portions of said shaft, said cable being nested within the groove and traveling along a longitudinal length of said shaft;

a manually operable controller coupled to one said cable end portions;

a first deformably resilient spring member intercalated within said centrally registered sleeve and operably fastened to said cable adjacent said controller;

a second deformably resilient spring member nested within said distal end portion of said shaft;

a plurality of interlocked pins operably coupled to said cable and said distal end portion of said shaft; and a release lever pivotally connected to said shaft and being movable between raised and lowered positions;

wherein said first and second spring members cooperate with said pins for positioning said cable between tensed and equilibrium states when the operator disengages said controller so that said plow section can be locked at alternately displaced angles offset from said shaft.

4. The apparatus of claim 3, wherein said automatic biasing means comprises:

a plurality of oppositely disposed helical spring members equidistantly offset from said shaft; and a plurality of brackets securely affixed to said distal end portion of said shaft and a rear surface of said plow section respectively;

wherein said helical spring members have opposed end portions fastened to said brackets, said helical spring members resisting a rotational force exerted thereon when said plow section is biased along alternate radial paths.

5. A hand-operable apparatus for shoveling snow and the like, said apparatus comprising:

an elongated shaft having axially offset proximal and distal end portions, said shaft including a plurality of bifurcated and adjustable grip covers removably conjoined about an outer surface thereof and situated adjacent said proximate end portion, said shaft being provided with a centrally registered sleeve formed therein;

an arcuately shaped plow section affixed to said distal end portion of said shaft, said plow section including a heel support having an arcuately shaped top surface symmetrically contoured with a removable bottom edge of said plow section for assisting to maintain said plow section registered along a horizontal plane during operating conditions, said plow section further including a plurality of fastening members spaced along said bottom edge for removing said bottom edge such that said bottom edge can be sharpened or replaced, said plow section having a non-uniform interior radius;

means for selectively pivoting said plow section between alternate radial paths during operating conditions; and means for automatically biasing said plow section to an equilibrium position after said plow section is biased to a pivoted position, said automatic biasing means cooperating with said pivoting means in such a manner that an operator can effectively remove snow from a ground surface while propelling said apparatus in a forward and substantially horizontal direction;

wherein said plow section has a linear top edge transversely registered with said shaft and traveling downwardly along an arcuate path;

wherein said removable linear bottom edge is situated subjacent said top edge and spans across a width of said plow section in such a manner that said bottom and top edge define a congruous surface area monolithically formed therebetween;

wherein said plow section has a pair of laterally positioned open end portions monolithically formed with said top and bottom edges, one said open end portions having a diameter greater than a diameter of another said oven end portions so that snow can be laterally directed across said surface area while said apparatus is propelled along a forward direction orthogonal to a width of said plow section;

wherein said pivoting means comprises:

a flexible and elongated cable having opposed end portions disposed adjacent said proximal and distal end portions of said shaft, said cable being nested within the groove and traveling along a longitudinal length of said shaft;

a manually operable controller coupled to one said cable end portions;

a first deformably resilient spring member intercalated within said centrally registered sleeve and operably fastened to said cable adjacent said controller;

a second deformably resilient spring member nested within said distal end portion of said shaft;

a plurality of interlocked pins operably coupled to said cable and said distal end portion of said shaft; and a release lever pivotally connected to said shaft and being movable between raised and lowered positions;

wherein said first and second spring members cooperate with said pins for positioning said cable between tensed and equilibrium states when the operator disengages said controller so that said plow section can be locked at alternately displaced angles offset from said shaft.

6. The apparatus of claim 5, wherein said automatic biasing means comprises:

a plurality of oppositely disposed helical spring members equidistantly offset from said shaft; and a plurality of brackets securely affixed to said distal end portion of said shaft and a rear surface of said plow section respectively;

wherein said helical spring members have opposed end portions fastened to said brackets, said helical spring members resisting a rotational force exerted thereon when said plow section is biased along alternate radial paths.

* * * * *